US011143385B2

(12) United States Patent
Lu et al.

(10) Patent No.: US 11,143,385 B2
(45) Date of Patent: Oct. 12, 2021

(54) MANUFACTURING METHOD FOR LIGHT BOARD

(71) Applicant: Xiamen PVTECH Co., Ltd., Fujian (CN)

(72) Inventors: Fuxing Lu, Fujian (CN); Xiaoping Lan, Fujian (CN)

(73) Assignee: Xiamen PVTECH Co., Ltd., Fujian (CN)

( * ) Notice: Subject to any disclaimer, the term of this patent is extended or adjusted under 35 U.S.C. 154(b) by 0 days.

(21) Appl. No.: 16/872,360

(22) Filed: May 11, 2020

(65) Prior Publication Data

US 2021/0247049 A1 Aug. 12, 2021

(30) Foreign Application Priority Data

Feb. 12, 2020 (CN) ..... 202010088512.3

(51) Int. Cl.
*F21V 7/24* (2018.01)

(52) U.S. Cl.
CPC ..... *F21V 7/24* (2018.02)

(58) Field of Classification Search
None
See application file for complete search history.

(56) References Cited

U.S. PATENT DOCUMENTS

2007/0165421 A1* 7/2007 Sakai ..... G02B 6/009 362/612
2011/0176083 A1* 7/2011 Hamada ..... G02F 1/133603 349/61

* cited by examiner

*Primary Examiner* — Britt D Hanley
(74) *Attorney, Agent, or Firm* — Winston Hsu

(57) ABSTRACT

A manufacturing method for a light board includes step a, covering a light reflection layer on one surface of a galvanized plate; step b, producing a forming space by applying a stamping process along a direction from the light reflection layer to the galvanized plate; and step c, disposing a plurality of light bead bars on the light reflection layer. Accordingly, as one surface of the galvanized plate is covered by the light reflection layer, the application of the light reflection layer at the inner surface of the board increases the light reflection performance of the board so as to improve the whole lighting effect and the illumination performance of the light board. Moreover, as the outer surface of the board is the galvanized plate, the outer surface of the board has the anti-corrosion effect.

3 Claims, 5 Drawing Sheets

MANUFACTURING METHOD FOR LIGHT BOARD

CROSS REFERENCE TO RELATED APPLICATION

This application claims the benefit of priority of China Patent Application No. 202010088512.3, filed 2020 Feb. 12, and included herein by reference in its entirety.

BACKGROUND OF THE INVENTION

1. Field of the Invention

The present invention relates to a light board, in particular to a manufacturing method for light boards.

2. Description of the Prior Art

In general, for manufacturing a direct-lit light board, an iron plate is used, and then two surfaces of the iron plate is coated by a polypropylene coating layer and a polyethylene terephthalate coating layer. Because the iron plate is easy to be rusted, the polypropylene coating layer is used for retarding the rustiness of the board. As a result, both the overall manufacturing coast and the manufacturing time for the board increase, thereby being harmful to mass production. An alternate approach using iron plate for manufacturing a light board is spray painting the iron plate with light reflection inks. This approach is fast but the manufacturing cost is expensive and has insufficient economic benefits.

In view of the problem that the iron plate is easy to be rusted, the iron plate is replaced by the galvanized plate. In general, the galvanized plate is stamped firstly, and then the inner layer of the galvanized plate is covered with a light reflection layer. However, in the process for attaching the light reflection layer on the galvanized plate, as the galvanized plate is deformed by the stamping process, the size of the deformed galvanized plate for attaching the light reflection layer has to be calculated, and the light reflection layer has to be cut before attaching on the galvanized plate. The foregoing approach though does not have the problem of rust of plate, however the manufacturing for the galvanized plate and the covering of the light reflection layer are complicated and inconvenient.

Therefore, how to solve the foregoing problems is an issue to be considered.

SUMMARY OF THE INVENTION

In view of these, an embodiment of the present invention provides a manufacturing method for a light board. The manufacturing method comprises step a, covering a light reflection layer on one surface of a galvanized plate; step b, producing a forming space by applying a stamping process along a direction from the light reflection layer to the galvanized plate; and step c, disposing a plurality of light bead bars on the light reflection layer.

According to one embodiment for the manufacturing method, the galvanized plate after being stamped comprises a base and a plurality of side plates. The side plates are extending from the base, extending along a direction, and connected to each other. The base and the side plates form the forming space.

According to one embodiment for the manufacturing method, the light reflection layer is made of polyethylene terephthalate.

According to one embodiment for the manufacturing method, the light reflection layer partially covers the galvanized plate.

According to one or more embodiments of the present invention, the manufacturing method has following features. As one surface of the galvanized plate is covered by the light reflection layer, the application of the light reflection layer at the inner surface of the board increases the light reflection performance of the board so as to improve the whole lighting effect and the illumination performance of the light board. Moreover, as the outer surface of the board is the galvanized plate, the outer surface of the board has the anti-corrosion effect.

These and other objectives of the present invention will no doubt become obvious to those of ordinary skill in the art after reading the following detailed description of the preferred embodiment that is illustrated in the various figures and drawings.

DETAILED DESCRIPTION

The detailed description of the technical content, structural features, and the objects and effects of the technical solutions will be described in detail below with reference to the specific embodiments and the accompanying drawings.

Figure 1:
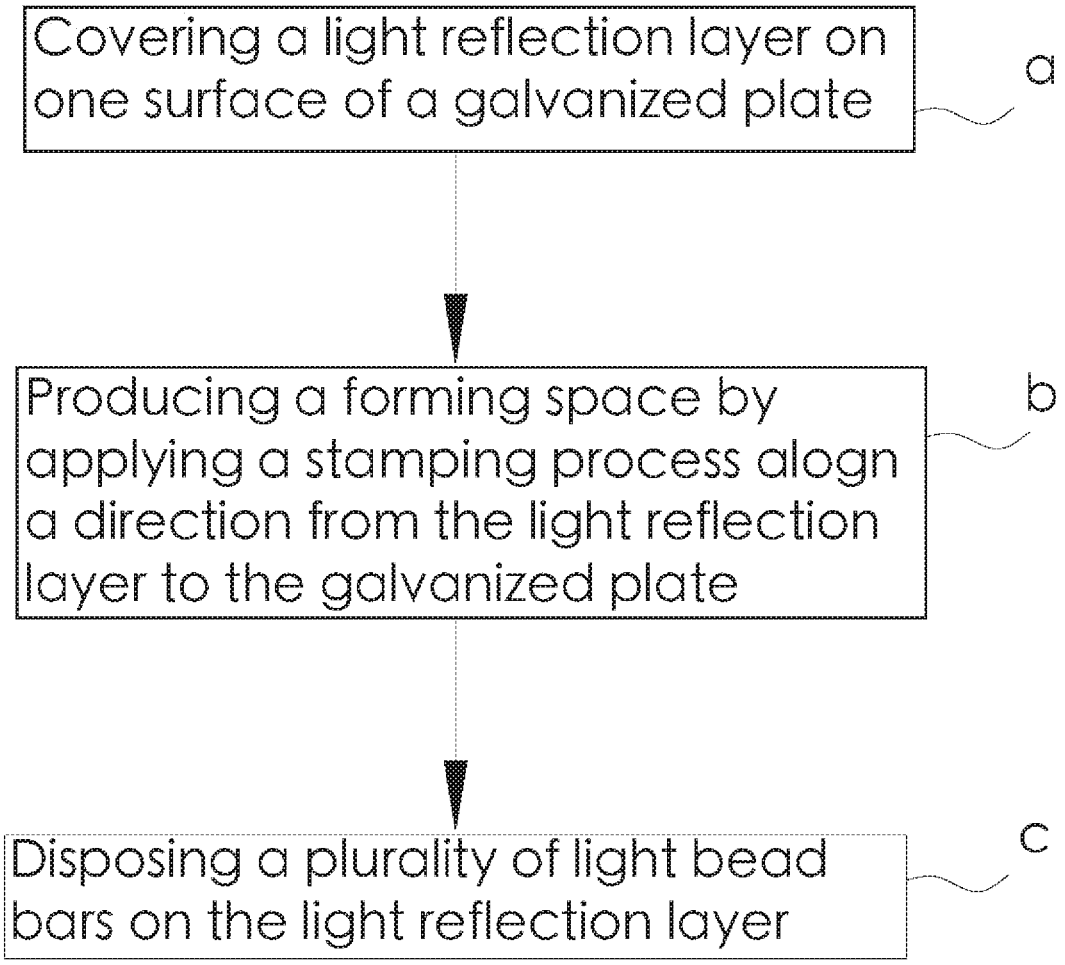
FIG. 1 illustrates a schematic flowchart of a manufacturing method for light board according to an exemplary embodiment of the present invention.
Figure 2:
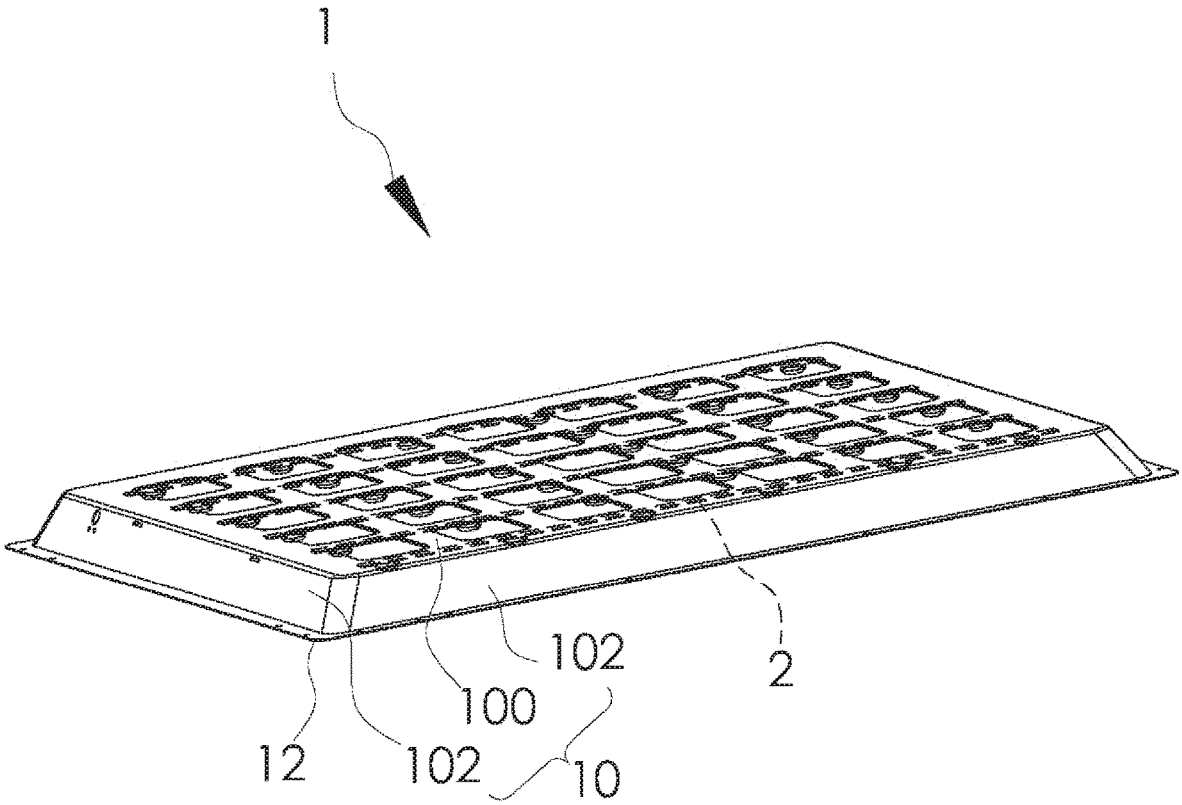
FIG. 2 illustrates a perspective view of a light board according to an exemplary embodiment of the present invention.

Please refer to FIGS. 1 and 2. FIG. 1 illustrates a schematic flowchart of a manufacturing method for light board according to an exemplary embodiment of the present invention. FIG. 2 illustrates a perspective view of a light board according to an exemplary embodiment of the present invention. According to the embodiment, the manufacturing method for light board comprises step a, covering a light reflection layer on one surface of a galvanized plate; step b, producing a forming space by applying a stamping process along a direction from the light reflection layer to the galvanized plate; and step c, disposing a plurality of light bead bars on the light reflection layer.

Figure 4:
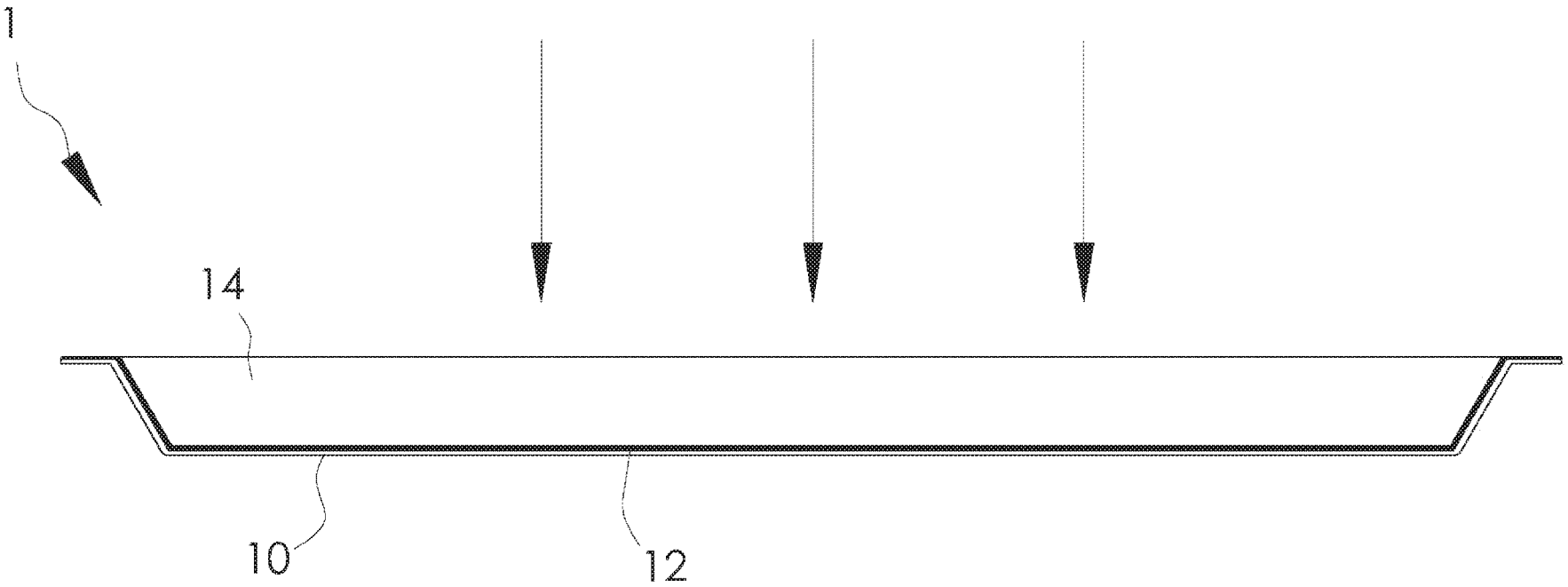
FIG. 4 illustrates a schematic cross-sectional view showing that the galvanized plate is stamped.

The light board 1 manufactured according to the aforementioned steps comprises a galvanized plate 10 and a light reflection layer 12. One surface of the galvanized plate 10 is covered with the light reflection layer 12. A forming space 14 (as shown in FIG. 4) is formed on the galvanized plate 10 by applying a stamping process along a direction from the light reflection layer 12 to the galvanized plate 10. The galvanized plate after being stamped 10 comprises a base 100 and a plurality of side plates 102. The side plates 102 are extending from the base 100, extending along a direction, and connected to each other. The base 100 and the side plates 102 form the forming space 14. In an embodiment, the light reflection layer 12 is made of polyethylene terephthalate (PET).

Figure 3:
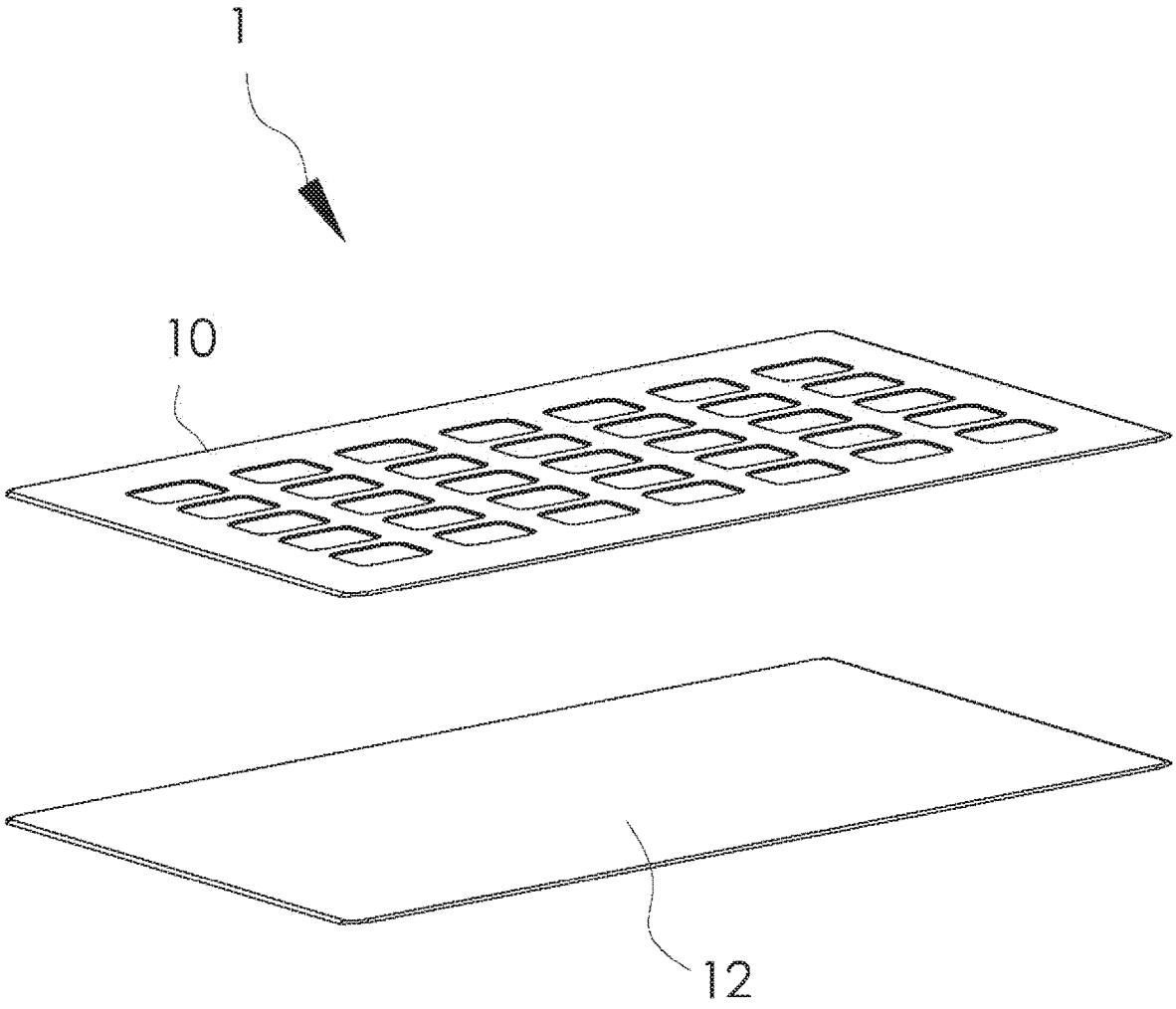
FIG. 3 illustrates a schematic exploded view showing the galvanized plate is covered by the light reflection layer of the light board of the exemplary embodiment.
Figure 5:
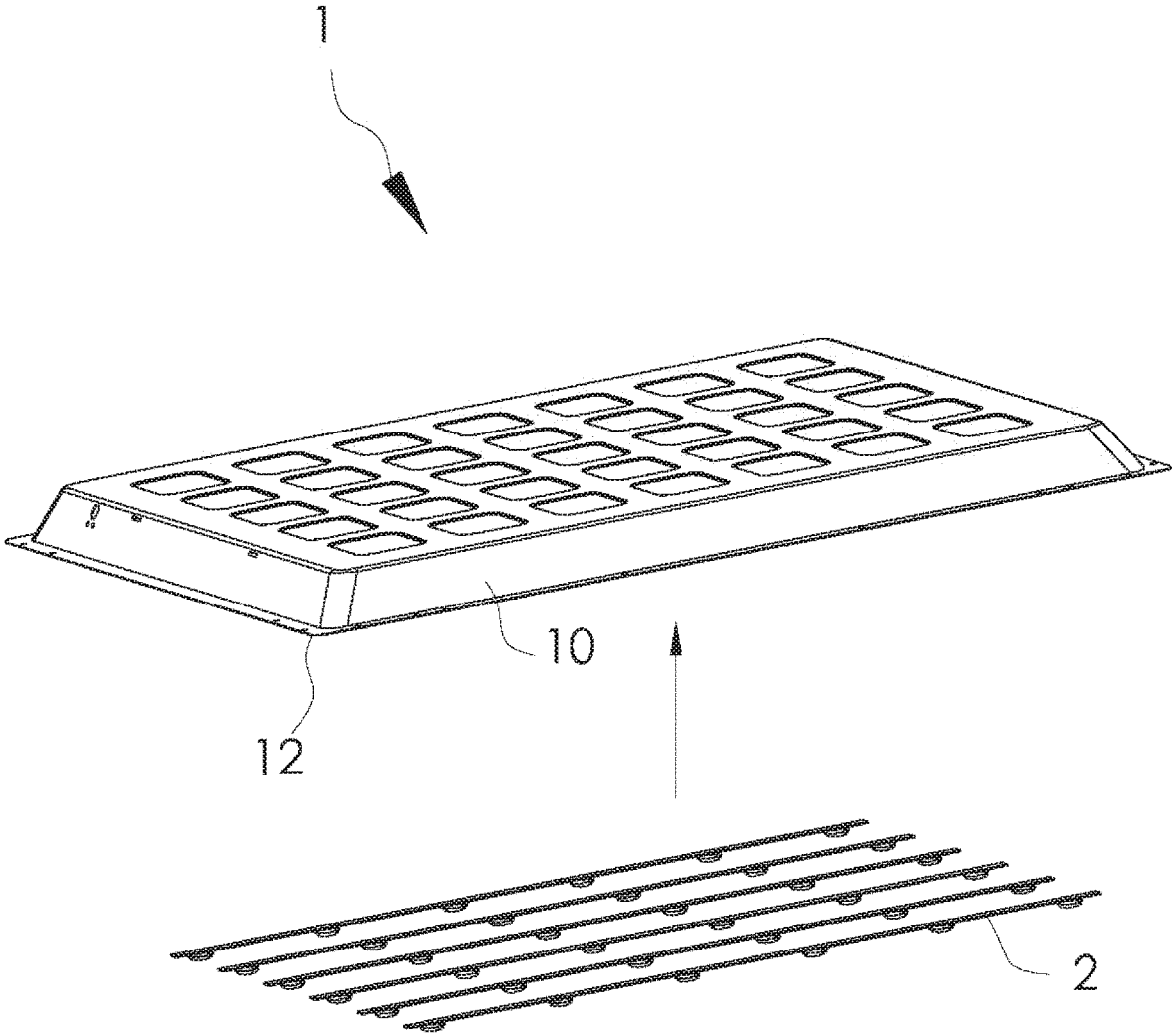
FIG. 5 illustrates a schematic perspective view showing the galvanized plate is combined with light bead bars.

Please further refer to FIGS. 3 to 5. FIG. 3 illustrates a schematic exploded view showing the galvanized plate is covered by the light reflection layer of the light board of the exemplary embodiment. FIG. 4 illustrates a schematic cross-sectional view showing that the galvanized plate is stamped. FIG. 5 illustrates a schematic perspective view showing the galvanized plate is combined with light bead bars. As shown, in the manufacturing process for the light board 1, before applying the stamping process, one surface of the galvanized plate 10 is covered with the light reflection layer 12. Next, the stamping process is applied to the galvanized plate 10 covering with the light reflection layer 12; the stamping is applied in a direction from the light reflection layer 12 toward the galvanized plate 10, so that the forming space 14 is formed after the stamping process. Last, the light bead bars 2 are placed on and fixed on the light reflection layer 12 and located in the forming space 14. Therefore, the light emitted from the light bead bars 2 can have a light reflection performance by emitting toward the light reflection layer 12 so as to increase the whole lighting effect and the illumination performance of the light board 1. Moreover, as the outer surface of the light board 1 is the galvanized plate 10, the outer surface of the light board 1 has the anti-corrosion effect.

The position and the coverage of the light reflection layer 12 can be adjusted to cover the galvanized plate partially according to the actual range to be illuminated by the light bead bars 2.

Although particular embodiments of the invention have been described in detail for purposes of illustration, various modifications and enhancements may be made without departing from the spirit and scope of the invention. Accordingly, the invention is not to be limited except as by the appended claims.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A manufacturing method for a light board, comprising:

step a, covering a light reflection layer on one surface of a galvanized plate; step b, producing a forming space by applying a stamping process along a direction from the light reflection layer to the galvanized plate; and step c, disposing a plurality of light bead bars on the light reflection layer;

wherein the galvanized plate after being stamped to comprise a base and a plurality of side plates, the side plates are extending from the base, extending along a direction, and connected to each other, wherein an included angle of each of the side plates and the base is greater than 90° but less than 180°, and the base and the side plates form the forming space.

2. The manufacturing method according to claim 1, wherein the light reflection layer is made of polyethylene terephthalate.

3. The manufacturing method according to claim 1, wherein the light reflection layer partially covers the galvanized plate.

* * * * *